US010201218B2

(12) United States Patent
Perlik

(10) Patent No.: US 10,201,218 B2
(45) Date of Patent: Feb. 12, 2019

(54) RECEPTACLE HAVING LOCKING HANDLES

(71) Applicant: Frank Perlik, Hudson, NY (US)

(72) Inventor: Frank Perlik, Hudson, NY (US)

( * ) Notice: Subject to any disclaimer, the term of this patent is extended or adjusted under 35 U.S.C. 154(b) by 292 days.

(21) Appl. No.: 14/920,571

(22) Filed: Oct. 22, 2015

(65) Prior Publication Data

US 2016/0113372 A1 Apr. 28, 2016

Related U.S. Application Data

(60) Provisional application No. 62/066,990, filed on Oct. 22, 2014.

(51) Int. Cl.

| | |
|---|---|
| ***A45C 13/26*** | (2006.01) |
| ***D06F 95/00*** | (2006.01) |
| ***A45C 5/00*** | (2006.01) |
| ***A45C 5/04*** | (2006.01) |

(52) U.S. Cl.

CPC ..... *A45C 13/26* (2013.01); *A45C 5/00* (2013.01); *A45C 5/045* (2013.01); *D06F 95/002* (2013.01)

(58) Field of Classification Search

CPC .. A45C 3/04; A45C 5/00; A45C 5/045; A45C 13/26; D06F 95/002; Y10T 16/44

USPC ..... 220/676, 761–763, 769, 772

See application file for complete search history.

(56) References Cited

U.S. PATENT DOCUMENTS

| | | | |
|---|---|---|---|
| 3,057,508 | A | 10/1962 | Kimbrough, Jr. |
| D277,993 | S | 3/1985 | Sinchok |
| D326,552 | S | 5/1992 | Goodell |
| D343,711 | S | 1/1994 | Craft et al. |
| 5,469,986 | A | 11/1995 | Jang |
| D364,961 | S | 12/1995 | Rehrig |
| D416,116 | S | 11/1999 | Sofy |
| D536,874 | S | 2/2007 | Splain et al. |
| D553,361 | S | 10/2007 | Splain et al. |
| 7,677,408 | B2 | 3/2010 | Loucks et al. |
| D622,507 | S | 8/2010 | Walter |
| 7,780,036 | B2 | 8/2010 | Splain et al. |
| D691,341 | S | 10/2013 | Barre et al. |

(Continued)

FOREIGN PATENT DOCUMENTS

| | | |
|---|---|---|
| CN | 203087855 U | 7/2013 |

OTHER PUBLICATIONS

Plastic Laundry Basket with Handle and Lid, http://sanadaseiko.trustpass.alibaba.com/product/113450079-101847822/Plastic_laundry_basket_45L_w_handle_and_lid.html.

(Continued)

*Primary Examiner* — James N Smalley
*Assistant Examiner* — Madison L Poos
(74) *Attorney, Agent, or Firm* — Schmeiser, Olsen & Watts, LLP

(57) ABSTRACT

A receptacle including a wall portion extending from a bottom surface to a rim, the rim having an internal lip extending around the rim, wherein the wall portion includes at least one recessed area to accommodate a side of a user when the user is carrying the receptacle, a first handle operably attached to the receptacle, and a second handle operably attached to the receptacle, wherein the first handle and the second handle releasably engage each other to form a single carrying handle, is provided. Furthermore, an associated method is also provided.

17 Claims, 12 Drawing Sheets

(56) References Cited

U.S. PATENT DOCUMENTS

| | | | | |
|---|---|---|---|---|
| 2005/0189360 | A1* | 9/2005 | Loucks | D06F 95/002 220/676 |
| 2006/0168761 | A1* | 8/2006 | Christensen | A45C 13/26 16/444 |
| 2013/0062357 | A1 | 3/2013 | Souza | |

OTHER PUBLICATIONS

Plastic Laundry Basket http://www.homesupplies-b2b.com/b2b/baby_supplies_and_products/5/plastic_laundry_basket_222.html.
Plastic Oval Basket With Handle http://www.walmart.com/ip/Deluxe-Import-Trading-11-HP8717-Plastic-Oval-Basket-With-Handle-Pack-of-36/30498547?wmlspartner=q5QZHUbC1j8&sourceid=2999111028356807982 3&oid=245517.30498547&affillinktype=15&veh=aff.
Plastic Supermarket shopping basket http://www.weiku.com/products/9462941/Plastic_supermarket_shopping_basket.html.

* cited by examiner

RECEPTACLE HAVING LOCKING HANDLES

CROSS-REFERENCE TO RELATED APPLICATIONS

This application is a non-provisional of and claims priority to U.S. Provisional Application No. 62/066,990, filed on Oct. 22, 2014, and entitled, "Receptacle Having Locking Handles," the entire contents of which are hereby incorporated by reference.

FIELD OF TECHNOLOGY

The following relates to embodiments of a receptacle and more specifically to embodiments of a receptacle having locking handles and an elongated profile.

BACKGROUND

Laundry baskets are very useful for carrying clothes to and from the washer and dryer. Typical laundry baskets are designed to be carried in front of the body due to their large sizes and awkwardly positioned handles. When these large laundry baskets are filled with clothes, it is hard to transport the basket around the house, especially up and down sets of stairs. Due to the size of the laundry basket and the total weight when filled with clothes, most people must exert significant energy to carry the basket up and down stairs with both arms in front of their body. This method of carrying of a heavy laundry basket presents a safety concern, especially while traversing a flight of stairs. Moreover, retail baskets, while relatively lightweight, are difficult to carry around even after a small amount of time. Retail baskets are provided by retailers for customers to help them carry multiple merchandise items while they continue to shop. However, the handles of the retail baskets tend to cause discomfort around a user's arm because they are thin, metal handles that can pinch down on a user's skin when it is carried.

Thus, a need exists for an apparatus and method for a receptacle having comfortable locking handles and an elongated profile for carrying a heavy load at a side of a user.

SUMMARY

A first aspect relates generally to a receptacle comprising a wall portion extending from a bottom surface to a rim, the rim having an internal lip extending around the rim, wherein the wall portion includes at least one recessed area to accommodate a side of a user when the user is carrying the receptacle, a first handle operably attached to the receptacle, and a second handle operably attached to the receptacle, wherein the first handle and the second handle releasably engage each other to form a single carrying handle.

A second aspect relates generally to a basket comprising: a body portion having a first end and an opposing second end, the body portion defined by a sidewall that extends from the first end to the second end and a bottom surface, wherein the body portion includes an internal region for accommodating one or more items, a first handle operably attached to the body portion, the first handle including a cavity, a second handle operably attached to the body portion, wherein, when the basket is in a carrying position, a portion of the second handle resides within the cavity of the first handle, such that the first handle and the second handle are securably engaged to each other, wherein, when the basket is in a stackable position, the first handle and the second handle are disengaged from each other, and the first handle and the second handle reside flush with a rim of the body portion.

A third aspect relates generally to a method comprising providing a receptacle having a wall portion extending from a bottom surface to a rim, the rim having an internal lip extending around the rim, wherein the wall portion includes at least one recessed area to accommodate a side of a user when the user is carrying the receptacle, and operably attaching a first handle and a second handle to the receptacle, wherein the first handle includes a cavity for receiving the second handle, wherein the first handle and the second handle releasably engage each other to form a single carrying handle The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
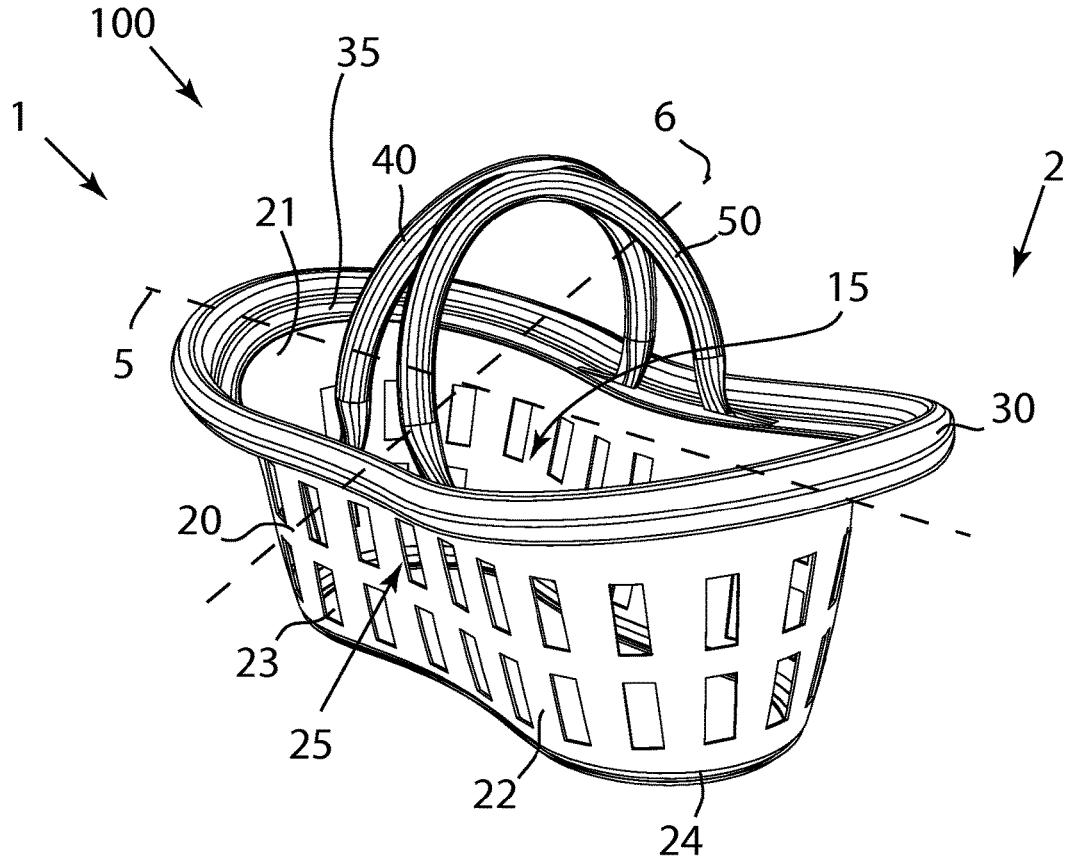
FIG. 1 depicts a perspective view of an embodiment of a receptacle in a carrying position.
Figure 2:
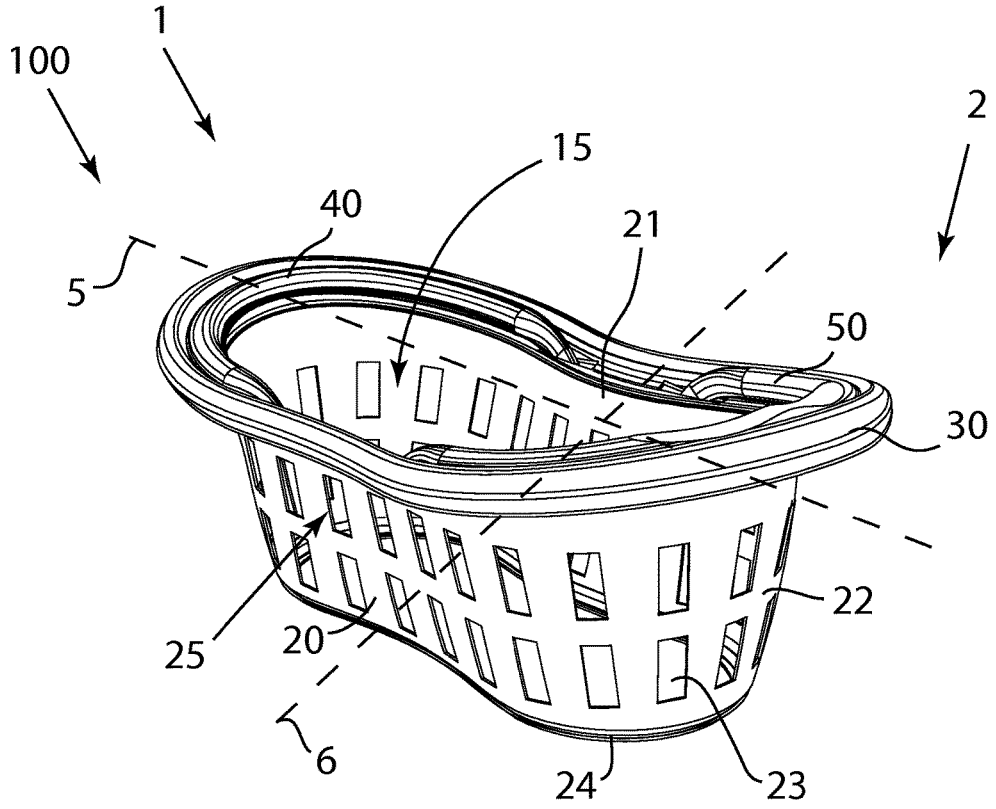
FIG. 2 depicts a perspective view of an embodiment of the receptacle in a storing position.

Referring to the drawings, FIGS. 1 and 2 depict an embodiment of a receptacle 100. Embodiments of a receptacle 100 may be a receptacle, a basket, a laundry basket, a retailer or grocery basket, a cart, a shopping cart, a portable carryable basket, a carrying device, a hamper, a carrier, a holder, a container, and the like, or any device that can be used to receive and hold contents. Embodiments of the receptacle 100 may be carried or otherwise portable. For example, a human being may be able to carry the receptacle 100 around their arm, in their hands, grabbed by a single hand, and the like, with or without contents loaded into the receptacle 100. Embodiments of the receptacle 100 may include a first end 1 and a second end 2, wherein the second end 2 may be an opposing end from the first end 1. The first end 1 and the second end 2 may be curved or rounded. A body of the receptacle 100 may be defined by a wall 20, wherein the wall 20 may include a plurality of openings 23. Embodiments of the openings 23 may be openings, gaps, slots, slits, apertures, and the like. The plurality of openings 23 may reduce the weight of the receptacle 100, and may allow passage of air through the receptacle 100. The size and of the openings 23 and the number of openings 23 may vary depending on the desired use of the receptacle 100. For example, the size of the openings 23 may be reduced if used as a shopping or grocery basket to prevent items from failing through the openings 23.

Embodiments of the wall 20 may include an inner surface 21 and an outer surface 22. Embodiments of the wall 20 may be a side of the receptacle, a sidewall, a wall portion, a wall, an edge, a perimeter, a frame, a body (or part of a body) of the receptacle, and the like. The wall 20 may extend continuously from the first end 1 to the second end 2 to form an internal region 15. For instance, the wall 20 may be a single wall that is shaped to form an interior region 15. Embodiments of the internal region 15 may be a space, an area, a cavity, an opening, a compartment, an inside area, a storage location, an accessible region, a receptacle, and the like, that can have a volume. The internal region 15 may be configured to receive contents, such as laundry, goods, groceries, items, etc. The internal region 15 may be further defined by a bottom surface 24 of the receptacle 100 and the wall 20 or side of the receptacle 100. The volume or space of the internal region 15 can vary in size, depending on a height of the wall 20 and an area of the bottom surface 24 of the receptacle 100. The internal region 15 may also be defined by a shape or a profile of the wall 20.

Figure 3:
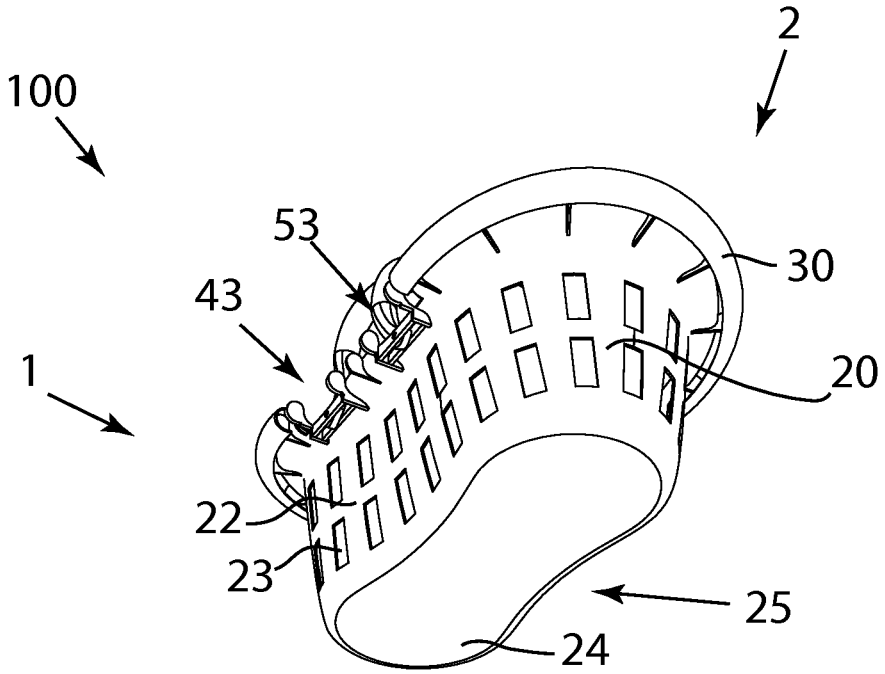
FIG. 3 depicts a bottom, perspective view of an embodiment of the receptacle.
Figure 4:
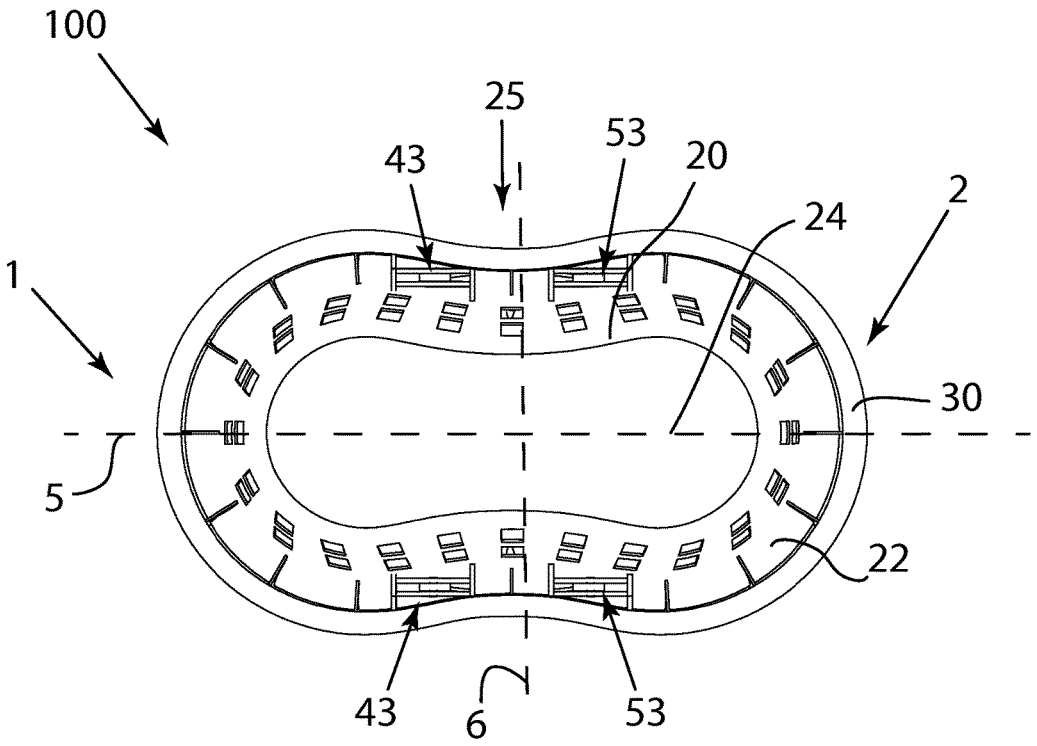
FIG. 4 depicts a bottom view of an embodiments of the receptacle.
Figure 5:
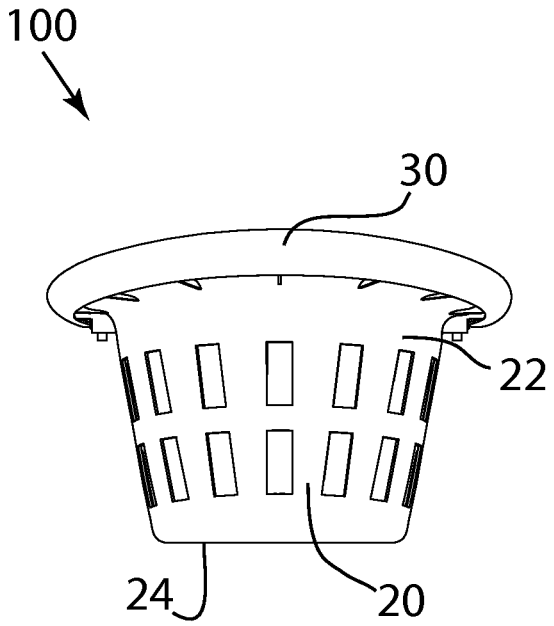
FIG. 5 depicts side view of front view of an embodiment of the receptacle in the storing position.
Figure 6:
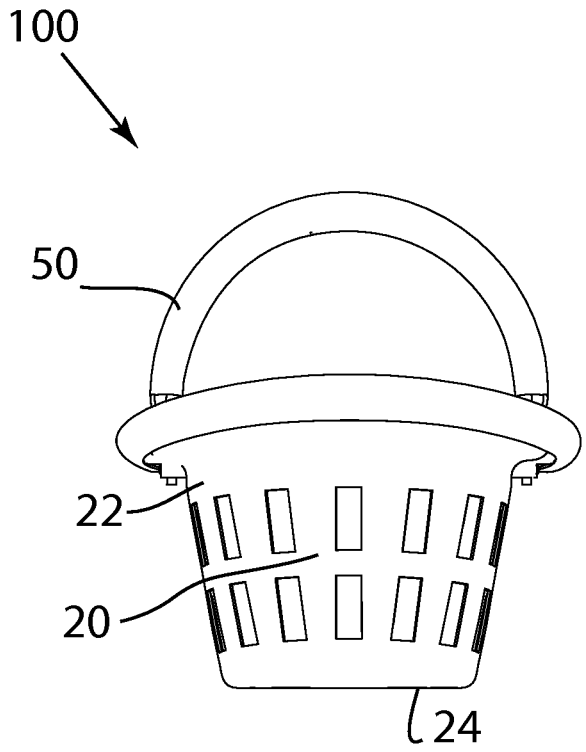
FIG. 6 depicts a front view of an embodiment of the receptacle in the carrying position.
Figure 7:
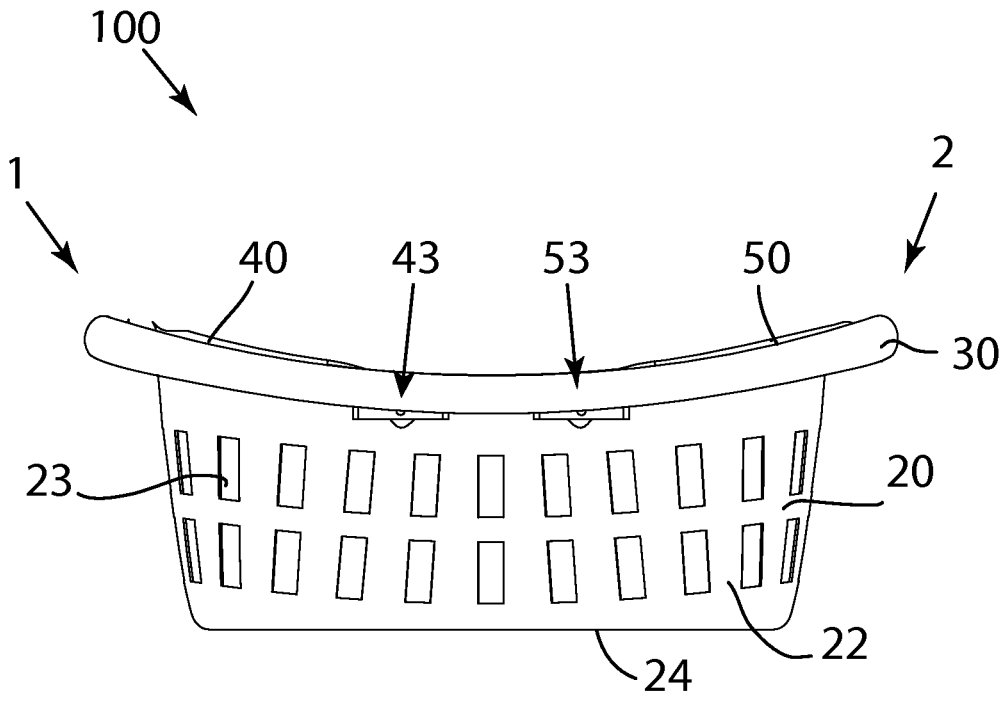
FIG. 7 depicts a side view of an embodiment of the receptacle in the storing position.
Figure 8:
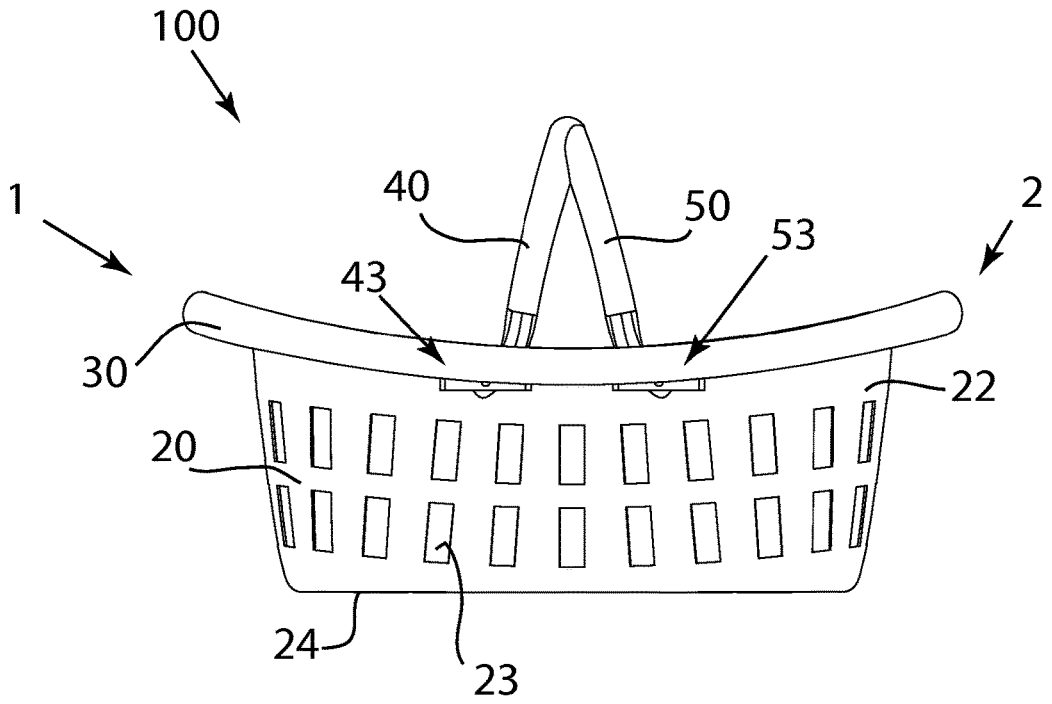
FIG. 8 depicts a side view of an embodiment of the receptacle in the carrying position.
Figure 9:
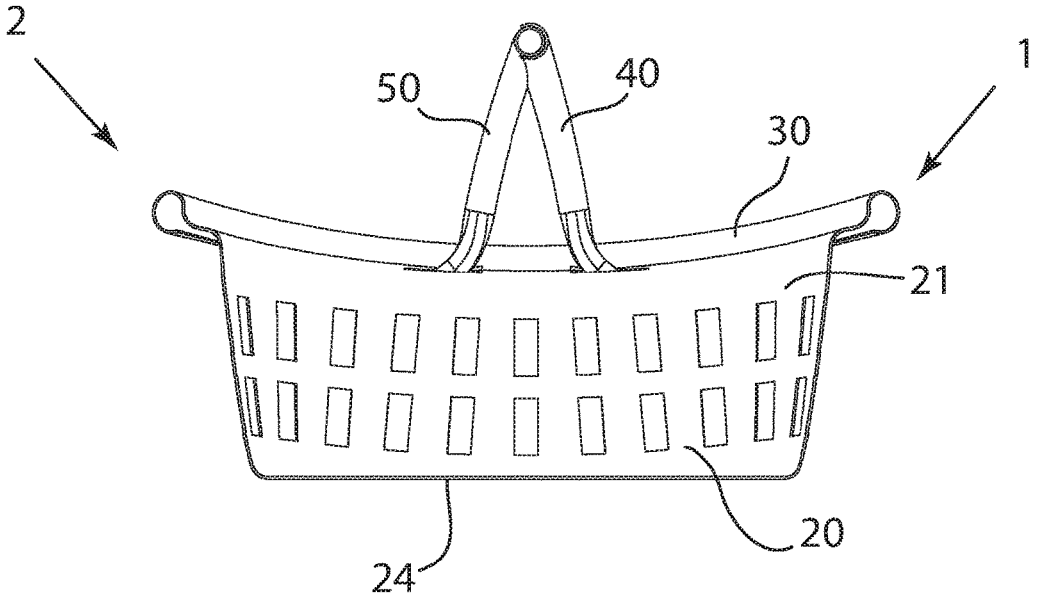
FIG. 9 depicts a side, cross-sectional view of the receptacle in the carrying position.
Figure 10:
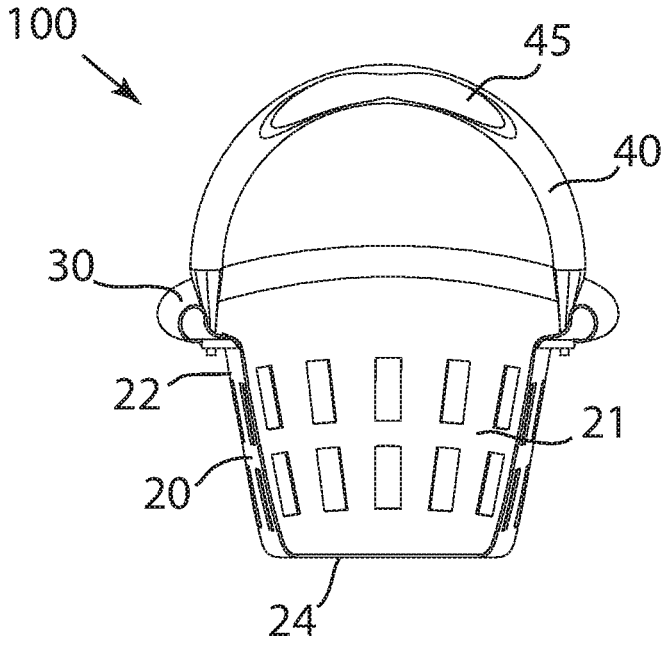
FIG. 10 depicts a front, cross-sectional view of an embodiment of the receptacle showing an embodiment of a cavity in one of the handles.

Furthermore, embodiments of the wall 20 of the receptacle 100 may extend from a bottom surface 24 to a rim 30 of the receptacle 100. The extension from the bottom surface 24 to a rim 30 may be defined by a height of the wall 20. Embodiments of the bottom surface 24 may be a continuous, rigid surface configured to support contents that are placed within the internal region 25, as shown in FIG. 3. However, the bottom surface 24 may include a plurality of openings or slots, similar to the openings 23 of the wall 20. The bottom surface 24 may be structurally integral with the wall 20, or may be operably attached to the wall 20 through various attachment means, including adhesives and/or fasteners. In addition, the bottom surface 24 may be comprised of the same material as the wall 20, or may be comprised of a material different than the wall 20 and operably attached to the wall 20. For instance, the bottom surface 24 could be a mesh material, or otherwise elastic/flexible/pliable material, to allow flex/deflection to increase a volume of the internal region 15 when goods, items, clothes, laundry, etc. are placed therein.

Referring now to FIGS. 4-7, embodiments of the receptacle 100 may include an elongated profile. The elongated profile of the receptacle 100 may allow a user to comfortably carry the receptacle 100 on their side. For example, the receptacle 100 may be elongated from a first end 1 to a second end 2. The receptacle 100 may include a longitudinal axis 5 defining a horizontal axis extending from the first end 1 to the second end 2. The longitudinal axis 5 may pass through a center point of the receptacle 100, splitting the receptacle 100 into two equal sections on either side of the horizontal axis. The receptacle 100 may also include a transverse axis 6, which is transverse to the longitudinal axis 5, defining a vertical axis. The transverse axis 6 may pass through the same center point as the longitudinal axis 5, and may split the receptacle 100 into two equal sections on either side of the vertical axis. Accordingly, a distance from the first end 1 to the transverse axis 6 (and from the second end 2 to the transverse axis 6) can be greater than a distance from a point between the first end 1 and the second end 2 to longitudinal axis 5. In other words, embodiments of the receptacle 100 may be elliptical or elongated.

Moreover, the elongated profile of the receptacle 100 may be defined by a recessed area 25 that may accommodate a user's hip or torso region when carrying the receptacle 100 at a side of the user. Embodiments of the receptacle 100 may include a recessed area 25 on both sides (e.g. elongated sides), or may be present on a single side of the receptacle 100. In other words, the body of the receptacle 100 may include concave, exterior side walls and rounded edges to add to the elongate profile/design for ease of carrying the receptacle 100 at a user's side. The recessed area 25 may include a recessed surface portion of the wall 20. The wall 20, proximate a center portion of the receptacle 100, may protrude or otherwise extend inwardly into the internal region 15. The recessed area 15 may be located on one side of the receptacle 100 or on both sides divided by the longitudinal axis 5. In an exemplary embodiment, the receptacle 100 can include a recessed area 25 on both sides of the receptacle 100 divided by the longitudinal axis 5, wherein the recessed areas 25 are located at the same point on the respective sides. The recessed surface portion of the wall 20 may be curved, rounded, concave, or otherwise curvilinear to form an ergonomic indentation or recessed area 25.

Embodiments of the receptacle 100 may further include a wall 20 that gradually tapers from a rim 30 to a bottom surface 24. For example, the wall 20 may gradually extend towards the internal region 15 as it approaches the bottom surface 24. Thus, a perimeter of the bottom surface 24 may be smaller than a perimeter formed by the rim 30; the rim 30 may extend beyond the wall 20 to form an overhang. The tapering profile of the wall 20 may allow for stacking one or more receptacles 100 on top of each other for retail use and/or home storage. Because the wall 20 may gradually narrow as it approaches the bottom surface 24, a second receptacle 100 can be placed within the internal region 15 of a receptacle without the bottom surface 24 of the second receptacle 100 contacting the bottom surface of the internal region of the receiving receptacle 100.

Referring back to FIGS. 1 and 3, embodiments of the receptacle 100 may include a rim 30. Embodiments of the rim 30 may be a lip, an edge, a rim, and the like. Embodiments of the rim 30 may have a circular, curved, or other curvilinear, cross-section, and may be solid or hollow. The rim 30 may be located at a top of the wall 20, and may extend laterally beyond the wall 20. In some embodiments, the rim 30 may be structurally integral with the wall 20. In other embodiments, the rim 30 may be a separate component that can be mechanically engaged with, adhered, or otherwise attached to the wall portion 20. The rim 30 may also follow and/or define the contour of the receptacle 100. For example, the rim 30 may be shaped to correspond to the recessed areas 25 of the receptacle 30. Embodiments of the rim 30 may also be flared around the entire body of the receptacle 100 to allow for convenient lifting and carrying of the receptacle 100 at any position without a need to use the first handle 40 and/or the second handle 50. Moreover, embodiments of the rim 30 may include a lip 35. Embodiments of lip 35 may be an edge, a surface, an inner lip, an engagement surface, and the like, that may be located along the entire rim 30. The lip 35 may be disposed along the rim 30 on a side of the rim 30 facing the internal region 15. The lip 35 of the rim 30 may be configured to accommodate a first handle 40 and a second handle 50 in a first position, described in greater detail infra. Thus, the lip 35 may be positioned below a top portion of the rim 30 at least a distance to accommodate at least a portion of the first handle 40 and the second handle 50. In an exemplary embodiment, the lip 35 may be positioned below the top portion/surface of the rim 30 to accommodate, receive, etc. the entire cross-section of the handles 40, 50 such that the handles 40, 50 can be flush with the rim 30 in the first position. Further, the lip 35 of the rim 30 may match the contour of the rim 30 and also match a contour and/or shape of the first handle 40 and the second handle 50.

Embodiments of the receptacle 100 may further include a first handle 40 and a second handle 50. Embodiments of the handles 40, 50 may be operably connected to the receptacle 100. For example, the handles 40, 50 may be hingedly or pivotally connected to the receptacle 100, wherein the handles 40, 50 may pivot about the transverse axis 6 of the receptacle 100. The handles 40, 50 may be operably connected to the receptacle 100 via one or more connectors 43, 53. The connectors 43, 53 may mechanically connect the handles 40, 50 to the body of the receptacle 100, and may be located on opposing sides of the receptacle 100, as divided by the longitudinal axis 5. Embodiments of the connectors 43, 53 may be located underneath the rim 30, wherein the rim 30 overhangs from the wall 20. The overhanging rim 30 can prevent the connectors 43, 53 from contacting a user's hip or side, which could cause discomfort when carrying the receptacle 100. Furthermore, the connectors 43, 53 may include at least one pivot point to allow for the movement of the handles 40, 50 from a first position to a second position. For instance, embodiments of the connectors 43, 53 may include a rod or pin that is perpendicular to the wall 20 and passes through an opening of the handle 40, 50. Those having skill in the art should appreciate that other mechanical connectors and mechanisms may be utilized to accomplish the pivoting movement of the handles 40, 50. Embodiments of the connectors 43, 53 may be positioned side-by-side or significantly close together on each side of the receptacle 100 such that, when the handles 40, 50 are moved from the first position to the second position (e.g. upright), they can be close enough to each other to engage with each other.

Referring still to FIG. 1, and with additional reference to FIGS. 2 and 8-12, embodiments of the handles 40, 50 may lock together to facilitate the carrying and/or transporting the receptacle 100. For instance, embodiments of the handles 40, 50 may snap together to form a single, rigid, handle for carrying the receptacle 100. The snap engagement of the first handle 40 and the second handle 50 may be releasable by separating the first handle 40 and the second handle 50 with a limited amount of force, but remain together during use and/or carrying of the receptacle 100. The snap engagement of the first handle 40 and the second handle 50 may be accomplished by an interference fit between the two components. For instance, embodiment of the first handle 40 may include a cavity 45. Embodiments of the opening 45 may be a recessed area, a gap, a cavity, a void, a depression, and the like. The cavity 45 may extend within the first handle 40. Embodiments of the cavity 45 of the first handle 40 may be configured to receive a portion of the second handle 50. In other words, the user simply needs to bring the first handle 40 and the second handle 50 together such that the second handle 50, or a portion thereof, snaps into the cavity 45 to establish a locked position. The cavity 45 may be sized and dimensioned to snugly engage the second handle 50. Those having skill in the art should appreciate that a cavity may be formed on the second handle 50, and accept the first handle 40 without a cavity. In alternative embodiments, the second handle 50 may include a protrusion or bump that is configured to fit within the cavity 45 of the first handle 40. In further embodiments, the first handle 40 and the second handle 50 could be snapped together using a snap fastener, such as a circular lip under one disc, attached to the first handle 40, that fits into a corresponding groove on the top of another disc attached to the second handle 50, holding the handles 40, 50 together until a certain amount of force is applied.

Figure 11:
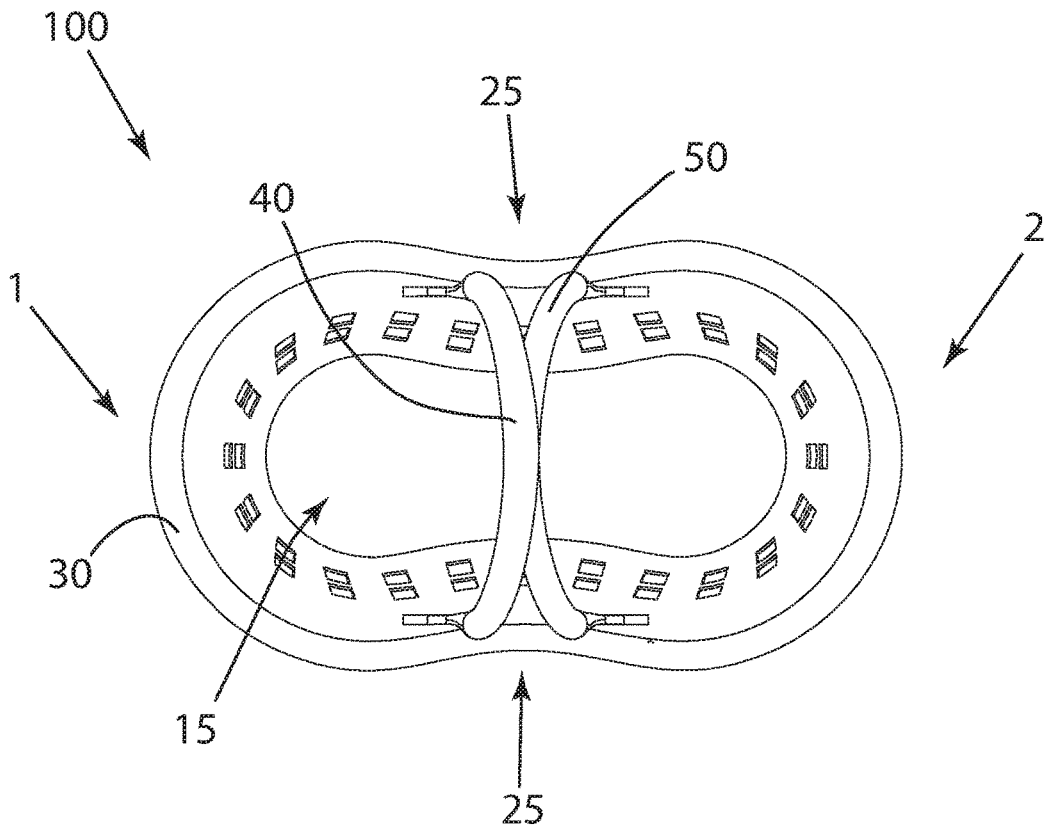
FIG. 11 depicts a top view of an embodiment of the receptacle in the carrying position.
Figure 12:
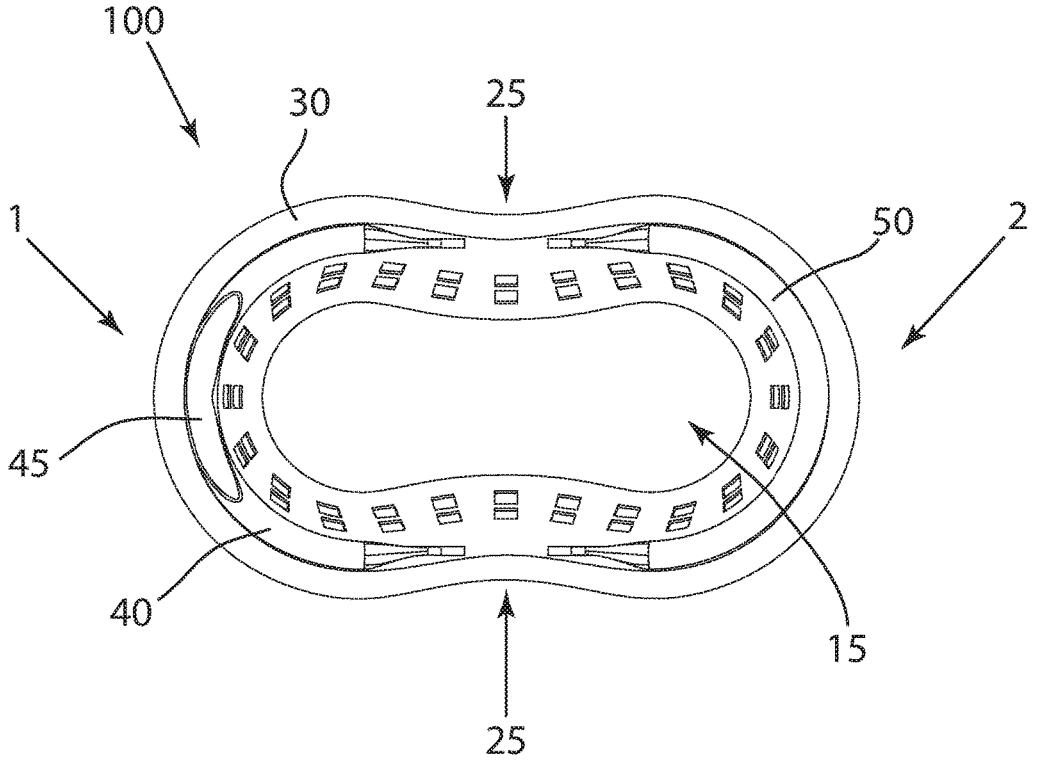
FIG. 12 depicts a top view of an embodiment of the receptacle in the storing position.

With continued reference to the drawings, FIGS. 1-2 and 11-12 depict embodiments of receptacle 100 in a first position and a second position. FIGS. 2 and 12 depict embodiments of the receptacle 100 in a first position. The first position may refer to a position where the first handle 40 and the second handle 50 are not engaged with each other. When the receptacle 100 is not being used, or is being stored, the handles 40, 50 may be snapped into the rim 30. For instance, the first handle 40 and the second handle 50 may be mechanically engaged with the lip 35 of the rim 30. The rim 30 may be sized and dimensioned such that when the first handle 40 and the second handle 50 are in the first position, the handles 40, 50 fit snugly against the rim 30, and rest on the lip 35. In an exemplary embodiment, the handles 40, 50 fit against rim 30 on the lip 35 such that the handles 40, 50, when in the first position, are flush with or a top surface of the rim 30. If the handles 40, 50 are flush with or disposed below the top surface of the rim 30, stacking of multiple receptacles 100 becomes more reliable. For example, space can be saved when the receptacles 100 are stacked for storage or retail use.

FIGS. 1 and 11 depict embodiments of the receptacle 100 in a second position. The second position may refer to a position where the first handle 40 and the second handle 50 are engaged (e.g. snap engaged), in an upright or substantially upright position. While the receptacle 100 can be carried when in the first position or the second position, the configuration of the receptacle 100 in the second position allow a user to place their arm underneath the single, rigid handle portion formed by the union of the first handle 40 and the second handle 50.

Embodiments of the receptacle may be comprised of lightweight materials. For example, the receptacle 100, and components thereof, may be comprised of plastic materials, composites, and combinations thereof. Exemplary embodiments of the receptacle 100 may have a height of 10 inches to 20 inches and a width of 25 inches to 36 inches. Other embodiments of the receptacle 100 may be larger or smaller than those dimensions. Moreover, embodiments of the recessed areas 25 may be recessed at least two inches towards the internal region 15.

Referring to FIGS. 1-12, a method may comprise the steps of providing a receptacle 100 comprising a wall portion 20 extending from a bottom surface 24 to a rim 30, the rim 30 having an internal lip 35 extending around the rim 30, wherein the wall portion 20 includes at least one recessed area 25, pivotally mounting a first handle 40, and a second handle 50 to the wall portion 30, engaging the first handle 40 with the second handle 50 to form a single carrying handle, and disengaging the first handle 40 and the second handle 50, and securing the first handle 40 and the second handle 50 against the lip 35 of the rim 30.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A receptacle comprising:

a wall portion extending from a bottom surface to a rim, the rim having an internal lip extending around the rim, wherein the wall portion includes at least one concave recessed area to accommodate a hip or torso of a user when the user is carrying the receptacle;

a first pivotable handle operably attached to the receptacle and extending above the rim when the receptacle is in a first position; and a second pivotable handle operably attached to the receptacle and extending above the rim when the receptacle is in the first position;

wherein the first pivotable handle and the second pivotable handle releasably engage each other to form a single stationary carrying handle when the receptacle is in the first position; and further wherein, when the receptacle is in a second position, the first pivotable handle and the second pivotable handle are releasably secured within the lip of the rim such that both pivotable handles are flush with or below the rim.

2. The receptacle of claim 1, wherein the receptacle has an elongated profile.

3. The receptacle of claim 1, wherein the wall portion includes a plurality of openings to reduce a weight of the receptacle and to provide visual access to an internal region of the receptacle.

4. The receptacle of claim 1, wherein the receptacle is a laundry basket.

5. The receptacle of claim 1, wherein the receptacle is a shopping basket.

6. The receptacle of claim 5, wherein the shopping basket is stackable.

7. A basket comprising:

a body portion having a first end and an opposing second end, the body portion defined by a sidewall that extends from the first end to the second end and a bottom surface, wherein the body portion includes an internal region for accommodating one or more items;

a first handle operably attached to the body portion, the first handle including a cavity;

a second handle operably attached to the body portion;

wherein, when the basket is in a carrying position, a portion of the second handle resides within the cavity of the first handle, such that the first handle and the second handle are securably engaged to each other;

wherein, when the basket is in a stackable position, the first handle and the second handle are disengaged from each other, and the first handle and the second handle reside flush with a rim of the body portion, wherein the first handle and the second handle are releasably secured to the rim.

8. The basket of claim 7, wherein the body portion includes at least one recessed area located at a side of the body portion, such that when a user is carrying the basket in the carrying position, a hip or torso of the user is accommodated by the recessed area.

9. The basket of claim 7, wherein the rim of the body portion includes an internal lip, the internal lip physically engaging the first handle and the second handle when in the stackable position.

10. The basket of claim 7, wherein the basket is at least one of a shopping basket and a laundry basket.

11. The basket of claim 7, wherein the body portion is comprised of a light weight plastic material.

12. The basket of claim 7, wherein a width along a transverse axis of the body portion is greater at the rim of the body portion than at the bottom surface of the body portion.

13. The basket of claim 7, wherein a distance along a longitudinal axis of the body portion is significantly longer than a distance along a transverse axis of the body portion, such that the basket has an elongated profile.

14. The receptacle of claim 7, wherein the body portion includes a plurality of openings to reduce a weight of the receptacle and to provide visual access to an internal region of the receptacle.

15. A method comprising:

providing a receptacle having a wall portion extending from a bottom surface to a rim, the rim having an internal lip extending around the rim, wherein the wall portion includes at least one ergonomic indentation to accommodate a side of a user when the user is carrying the receptacle; and operably attaching a first handle and a second handle to the receptacle, wherein the first handle includes a cavity for receiving the second handle;

wherein the first handle and the second handle releasably engage each other to form a single carrying handle when the receptacle is in a first position; and further wherein the first handle and the second handle are releasably secured to the internal lip extending around the rim when the receptacle is in a second position.

16. The method of claim 15, wherein the receptacle has an elongated profile.

17. The method of claim 16, wherein, when the first handle and the second handle are releasably secured to the internal lip of the rim, the first handle and the second handle are flush with a top of the rim.

* * * * *